United States Patent [19]

Sugimoto et al.

[11] Patent Number: 5,017,046

[45] Date of Patent: May 21, 1991

[54] METHOD OF PROTECTING A STRUCTURE CONSTRUCTED ON GROUND LIABLE TO BE LIQUEFIED

[75] Inventors: Tadao Sugimoto; Shigeki Tsuchiyama, both of Nagoya; Makoto Hayakawa, Kariya; Yozo Goto, Tokyo; Tadao Koide, Sayama; Tamotsu Endoh, Yokohama; Makoto Toriihara, Hidaka; Joji Ejiri, Tokyo, all of Japan

[73] Assignees: Ohbayashi Corporation, Osaka; Chubu Electric Power Company, Incorporated, Aichi, both of Japan

[21] Appl. No.: 433,205

[22] Filed: Nov. 8, 1989

[51] Int. Cl.[5] ..... E02D 19/00

[52] U.S. Cl. ..... 405/229; 52/169.5; 405/36

[58] Field of Search ..... 405/195, 204, 224, 229, 405/208, 207, 36, 43, 45; 52/169.5

[56] References Cited

U.S. PATENT DOCUMENTS

| | | | |
|---|---|---|---|
| 2,895,301 | 7/1959 | Casagrande et al. | 405/208 |
| 4,040,263 | 8/1977 | Eide et al. | 405/195 |
| 4,273,475 | 6/1981 | Fuller | 405/229 |
| 4,486,986 | 12/1984 | Cosenza | 405/36 X |
| 4,534,143 | 8/1985 | Goines et al. | 405/36 X |
| 4,693,637 | 9/1987 | Suzuki et al. | 405/224 |
| 4,881,846 | 11/1989 | Burkstaller | 405/37 |

*Primary Examiner*—Dennis L. Taylor

*Attorney, Agent, or Firm*—Wenderoth, Lind & Ponack

[57] ABSTRACT

A conglomerate layer is formed in ground which has a high water permeability and is liable to be liquefied. An underground base of the structure is constructed on the conglomerate layer. One or more drainpipes are extended substantially horizontally from the conglomerate layer through the underground base so as to communicate with the surface of the ground.

6 Claims, 1 Drawing Sheet

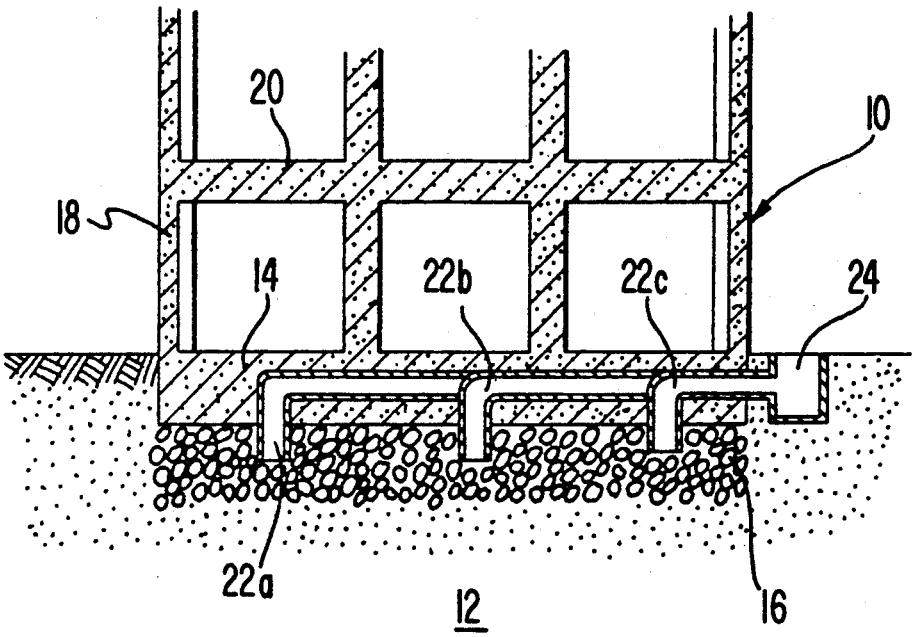
20
10
18
14
22b
22c
24
22a
12
16

METHOD OF PROTECTING A STRUCTURE CONSTRUCTED ON GROUND LIABLE TO BE LIQUEFIED

BACKGROUND OF THE INVENTION

1. Field of the Invention

The present invention relates to a method of protection of a structure constructed on ground which has a high water permeability and easily liquefies, such as sandy ground, and particularly to a protection method which is suitable to prevent sinking or floating of the structure.

2. Description of the Prior Art

When a structure is constructed on ground which has a high water permeability and easily liquefies, liquefaction may occur as a result of an earthquake because of elevation of the pressure of excessive pore water in the ground. Accordingly, in the past disasters caused by sinking or floating of such structures frequently have occurred as a result of earthquakes.

As a countermeasure to solve such a problem, there are known a method of improving the ground, a method of forming a gravel drain and a method of lowering of a ground-water level. However, to employ these methods, various conditions of the ground and restrictions on long term maintenance and management of the structures would be required. Thus, these methods are not frequently adopted.

A structure for preventing ground from liquefaction is disclosed in Japanese Provisional Patent Publication No. 127823/1983. However, this structure inevitably is accompanied by the following problems when it is actually used. Namely, in such structure, a predetermined number of drain pillars are provided in the base ground to support the structure. The drain pillars each comprise a concrete pillar having water permeability. On the outer circumference of the concrete pillar is formed a wall having water permeability with materials such as gravel, fine stone and slag. By this arrangement, it is attempted to employ the drain pillars to prevent an increase of the pressure of excessive pore water in the ground. However, it is difficult to construct such drain pillars under the structure, and even if possible, such construction requires a substantially high cost. Moreover, in the above-mentioned structure where the drain pillars are formed under the structure, the structure is liable to be floated by the pressure of water which elevates in the drain pillars when the ground becomes liquefied.

3. Object of the Invention

The present invention has been accomplished in an attempt to solve the above problems of the prior art. Therefore, it is an object of the invention to provide a method which can protect a structure constructed on ground which easily liquefies, which can prevent sinking or floating of the structure, and which can be achieved by a constructional operation that can be done easily and at low cost.

SUMMARY OF THE INVENTION

The present invention is directed to a method of protecting a structure constructed on ground which easily liquefies, comprising steps of forming a conglomerate layer horizontally on base ground which easily liquefies, forming an underground base of a structure on the conglomerate layer, and arranging one or more drainpipes extending substantially horizontally from the conglomerate layer through the underground base so as to communicate with the surface of the ground, thereby collecting excessive pore water in the ground by the conglomerate layer and draining the water to the surface of the ground through the drainpipes.

According to the method of the present invention, when the pressure of excessive pore water in the ground which easily liquefies, such as sandy ground, is increased by an earthquake, the excessive pore water first is collected in the conglomerate layer, and then the water is rapidly drained to the surface of the ground by the drainpipes embedded and extending substantially horizontally in the underground base. Accordingly, the increase of the pressure of the pore water in the ground under the underground base and the liquefaction of the ground are suitably controlled so that sinking or floating of the structure effectively can be prevented.

These and other objects, features and effects of the present invention will be more apparent from the following detailed description with reference to the accompanying drawing.

BRIEF DESCRIPTION OF THE DRAWING

The FIGURE is a cross section showing a structure constructed on ground which is liable to be liquefied and protected by a protection method according to the present invention.

DETAILED DESCRIPTION OF THE INVENTION

In the drawing, a structure 10 is located on sandy ground 12 which has a high water permeability and is liable to be liquefied. An underground base 14 of the structure 10 is positioned to be slightly embedded in the ground.

In the protection method of the invention, a conglomerate layer 16, which has a predetermined thickness and achieved by spreading and compacting conglomerate, is formed under a bottom plate 14 of the structure 10 before the structure 10 is constructed. The conglomerate layer 16 comprises conglomerate of a predetermined size spread over an area corresponding to the area of bottom plate 14 to be constructed.

After the conglomerate layer 16 is formed in the above manner, the underground base 14 is constructed on the layer 16, then side walls 18 and slabs 20 are constructed so as to form the structure 10.

Moreover, during the construction of the underground base 14, one or more horizontally extending hollow drainpipes **22*a*–22*c* are provided in base 14. In the illustrated embodiment, three drainpipes 22*a*–22*c* are provided. One end of each of the drainpipes 22*a*–22*c* is disposed in the conglomerate layer 16 and the other end thereof opens into a catch-basin 24, such as a storm drain, formed in the ground. Further as illustrated, each drainpipe includes a vertical length section extending through layer 16 into base 14 and a horizontal length section extending within and through base 14**. Also as illustrated, the opposite open ends of each drainpipe have opening areas substantially equal to the the cross-sectional area of the respective drainpipe.

In the arrangement constructed as mentioned above, when the pressure of pore water in the sandy ground 12 is increased by an earthquake, excessive pore water is collected in the conglomerate layer 16, and such water is rapidly drained to the catch-basin 24 through the drainpipes **22*a*–22*c* embedded in and horizontally extending through the base 14 of the structure 10. Thus, both the increase of the pressure of the pore water in the ground under the underground base 14 and liquefaction of the ground are controlled, so that sinking or floating of the structure 10** effectively can be prevented.

Moreover, since the protection method of the present invention comprises only the steps of forming the conglomerate layer under the underground base of the structure and arranging one or more drainpipes to extend substantially horizontally from the conglomerate layer through the underground base, the method can be realized with easy and low-cost construction.

What is claimed is:

1. A method of protecting a structure constructed on ground which is liable to be liquefied, said method comprising the steps of:

forming a conglomerate layer of a predetermined thickness horizontally on base ground which is liable to be liquefied by pore water including pore water flowing into said conglomerate layer from below;

forming an underground base of the structure on said conglomerate layer;

providing one or more drainpipes, each said drainpipe having at least first and second length portions, each said drainpipe having opposite first and second open ends, and each said open end having an area substantially equal to the cross-sectional area of the respective said drainpipe; and arranging each of said one or more drainpipes such that said first open end thereof is positioned within said conglomerate layer, said second open end thereof communicates with the surface of the ground and is at a level higher than said first open end, said first length portion thereof extends substantially vertically through said conglomerate layer into said underground base, and said second length portion thereof extends substantially horizontally within and through said underground base;

whereby excessive pore water in the ground first is collected in said conglomerate layer, flows through said first open end of each said drainpipe into said vertical first length portion thereof, and then flows through said horizontal second length portion thereof and discharges through said second open end thereof to the surface of the ground.

2. A method of protecting a structure according to claim 1, wherein said forming of said conglomerate layer comprises spreading and compacting conglomerate.

3. A method of protecting a structure according to claim 1, wherein said conglomerate layer is formed over an area substantially corresponding to the entire area of said underground base.

4. A method of protecting a structure according to claim 1, wherein at least one of said drainpipes extends to a catch-basin formed in the ground so as to communicate with the surface of the ground.

5. A method of protecting a structure according to claim 1, wherein said vertical first length portion of at least one said drainpipe terminates at said first opening thereof.

6. A method of protecting a structure according to claim 1, wherein said excessive pore water is caused to flow as the result of an earth tremor in the ground.

* * * * *